United States Patent [19]

Hamilton

[11] Patent Number: 4,487,532

[45] **Date of Patent: * Dec. 11, 1984**

[54] CONICAL WEDGE LOCK FOR CUTTER BLADE

[76] Inventor: Martin N. Hamilton, R.D. #4, Middle Rd., Meadville, Pa. 16335

[ * ] Notice: The portion of the term of this patent subsequent to Sep. 18, 2001 has been disclaimed.

[21] Appl. No.: 431,031

[22] Filed: Sep. 30, 1982

Related U.S. Application Data

[63] Continuation-in-part of Ser. No. 414,965, Sep. 7, 1982.

[51] Int. Cl.[3] ..... B26D 1/00

[52] U.S. Cl. ..... 407/37; 407/41; 407/49

[58] Field of Search ..... 407/37, 41, 42, 45, 407/49, 59, 62, 63, 85, 120; 83/677, 700

[56] References Cited

U.S. PATENT DOCUMENTS

| | | | |
|---|---|---|---|
| 1,089,527 | 3/1914 | Bolton | 407/41 |
| 1,422,988 | 7/1922 | Kienzl | 407/85 |
| 2,617,631 | 11/1952 | Shepherd | 76/101 A |
| 2,751,006 | 6/1956 | Lane | 407/85 |
| 3,195,376 | 7/1965 | Bader | 407/49 |
| 3,273,223 | 9/1966 | Wright | 407/52 |
| 3,672,017 | 6/1972 | Nielsen et al. | 407/63 |

FOREIGN PATENT DOCUMENTS

| | | | |
|---|---|---|---|
| 1293525 | 4/1969 | Fed. Rep. of Germany | 407/85 |
| 864554 | 4/1961 | United Kingdom | 407/41 |

*Primary Examiner*—Leonidas Vlachos

*Attorney, Agent, or Firm*—Charles L. Lovercheck; Wayne L. Lovercheck; Dale R. Lovercheck

[57] ABSTRACT

A locking device for holding a blade inserted in an axial groove in a cutting body is disclosed. The blades are usually helical and require a locking device that gives line contact between the locking device and the blade since such blades are made of carbide material which is quite brittle and would be distorted and fractured if the blade was contacted over a wide area. The locking devices are frustoconical in shape and have a screw holding them positively in position. The screw has a left hand thread on one end and a right hand thread on the other so that when the screw is rotated in one direction it loosens the clamping device and when it is moved in the other direction it tightens it.

1 Claim, 2 Drawing Figures

CONICAL WEDGE LOCK FOR CUTTER BLADE

REFERENCE TO PRIOR ART

This application is a continuation-in-part of patent application Ser. No. 414,965 filed on Sept. 7, 1982.

OBJECTS OF THE INVENTION

It is an object of the invention to provide a clamping device for helical blade inserts for cutting tools.

Another object of the invention is to provide a clamping device for cutting tool blades that is simple in construction, economical to manufacture, and simple and efficient to use.

Another object of the invention is to provide an improved clamping device.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
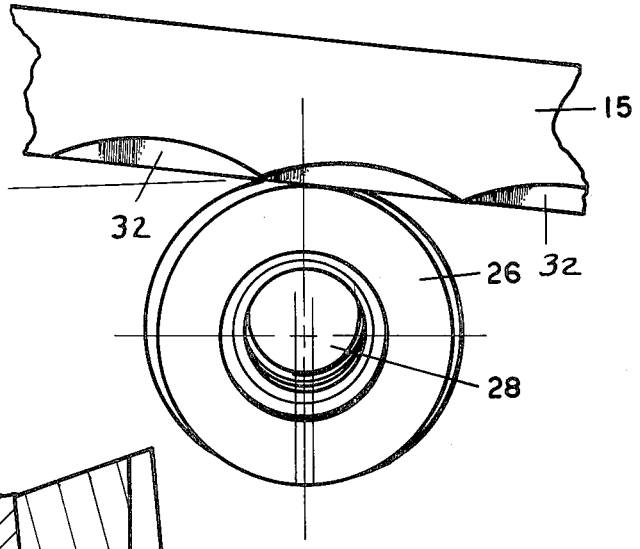
FIG. 1 is an enlarged partial view of a helical cutting blade and locking device according to the invention.
Figure 2:
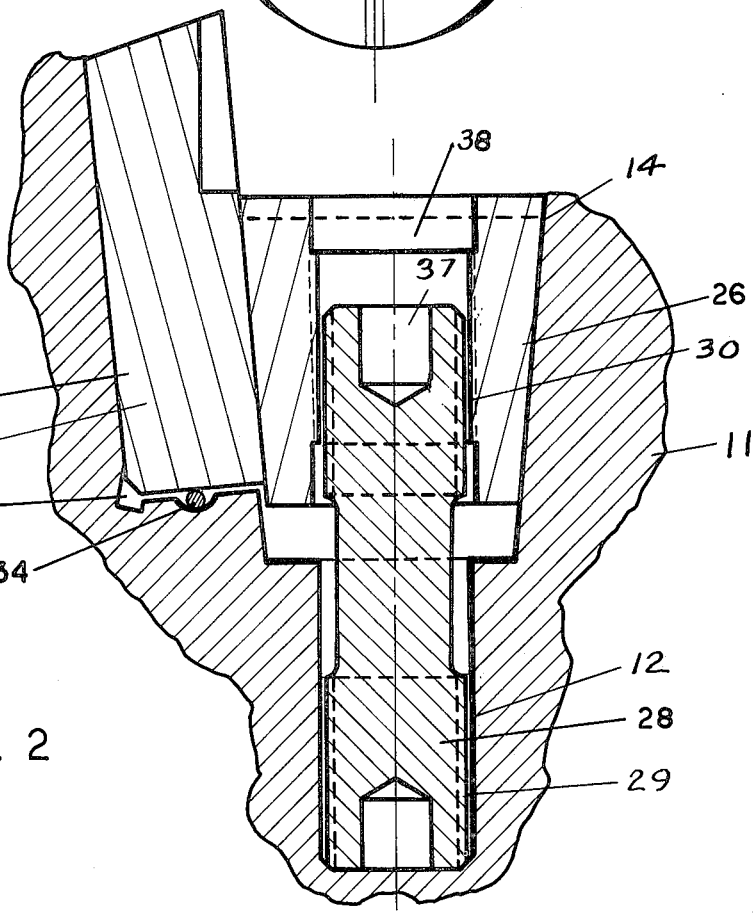
FIG. 2 is a transverse partial cross sectional view of a cylindrical cutting body with a helical blade locked in place by means of the locking member according to the invention.

Now, with more particular reference to the drawings, I show a combination 10 of a cutting tool body 11 and a blade 15 and a locking member 26. The blade 15 may be helical in shape and has scallops such as the scallops in the parent application. The locking device 26 is generally frustoconical in shape and has a threaded central bore 38 which threadably receives the upper end 30 of the locking screw 28. The other end of the locking screw is threaded at 29 and is received in the threaded bore 12 in the cutter body 11. The blade 15 is engaged by line contact of the locking member 26 on its leading edge. The blade 15 may be rectangular in cross section or any other shape. However, the locking device has particular utility with helical blades that are rectangular in cross section since a spiral blade rectangular in cross section requires a clamping member that gives line contact which is a feature of this invention and furthermore the double ended threaded screw holds the locking member contact line perpendicular to the sides of the blade.

The locking member is received in a frustoconical counterbore 14 of the threaded bore 12 and the thread in bore 12 is of opposite hand to the hand of the thread 30 in the hole 30 in the locking member. The screw 28 has a wrench receiving opening 37 by which it can be turned. The cutting blade 15 is supported in the slot 14 which is relieved at 35 and has a longitudinal groove that receives the piano wire 34. The piano wire 34 can be exchanged for a larger diameter wire when the blade is ground to sharpen it, to maintain the precise outer periphery of the cutting edge of the blade relative to the center line of the cutter body when the blade is sharpened.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a cutter body, a blade, and a locking means for locking said blade in said body, said cutter body being generally cylindrical in shape and having at least one axially extending helical slot therein, said slot having a bottom and a back, a plurality of elongated helical blade being made of relatively brittle material and having a top, bottom, back and front and being generally rectangular in cross section disposed in said slot, said blades each having a front, a top, a bottom and a back each joining the other, a cutting edge at the juncture of said top and front, comprising a plurality of longitudinally spaced notches formed in said cutting blade at said front and extending into said top and terminating in spaced relation to said back, each of said notches comprising a part of an inside cylindrical wall with the cylinder having its central longitudinal axis spaced from said front of said insert, generally perpendicular to said top surface, said notched cutting edge providing a plurality of adjacent intersectiong inside curved scallops, forming a continuous cutting edge at said top adapted to cut continuous, elongated, relatively narrow, generally wavy chips having a length about equal to the length of said blade, said locking means comprising a plurality of axially spaced radially extending bores in said body adjacent said slots, a plurality of frustoconical counter bores, one of said frustoconical counter bores being disposed concentric with each of said bores in said body, a plurality of frustoconical locking members, one said frustoconical locking member being disposed in each said frustoconical bore, each said frustoconical locking member having a central bore aligned with a said bore, said bores in said locking members being threaded in a first hand thread and said bores in said body being threaded in a second hand thread, a plurality of screws, each said screw having a first threaded end threadably engaging said bore in said locking member and a second end threadably engaging threads in a said bore in said body, whereby said screw may be rotated, drawing said frustoconical locking member into engagement with said front edge of said blade, clamping said blade in said slot, said groove in said cutter body having a longitudinally extending slot in the bottom thereof and a piano wire received in said slot whereby the blade is held in position.

* * * * *